United States Patent [19]

Leuvelink

BEST AVAILABLE COPY

[11] Patent Number: 4,488,347

[45] Date of Patent: Dec. 18, 1984

[54] METHOD OF AND APPARATUS FOR ARRANGING HELICAL COILS IN INTERDIGITATED SIDE-BY-SIDE DISPOSITION

[75] Inventor: Gerrit W. E. Leuvelink, Haaksbergen, Netherlands

[73] Assignee: Textiel Techniek Haaksbergen B.V., Haaksbergen, Netherlands

[21] Appl. No.: 281,384

[22] Filed: Jul. 8, 1981

[30] Foreign Application Priority Data

Jul. 12, 1980 [GB] United Kingdom ..... 8022869

[51] Int. Cl.[3] ..... B23P 19/04; B23P 11/02; B23P 19/02; B23P 21/00

[52] U.S. Cl. ..... 29/433; 29/450; 29/235; 29/241; 29/789; 140/3 R; 140/92.5; 245/6

[58] Field of Search ..... 29/433, 235, 241, 450, 29/410, 789; 140/3 R, 3 CA, 22, 92.5; 245/6, 5

[56] References Cited

U.S. PATENT DOCUMENTS

| | | | |
|---|---|---|---|
| 50,420 | 10/1865 | Kellogg | 245/6 UX |
| 145,907 | 12/1873 | Schpakowsky | 245/6 |
| 581,457 | 4/1897 | Deutsch | 245/6 UX |
| 2,183,169 | 12/1939 | Prentice | 29/410 |
| 2,550,898 | 5/1951 | Youngblood et al. | 29/241 |
| 2,740,615 | 4/1956 | Scholl | 245/6 X |
| 3,263,799 | 8/1966 | Bascom et al. | 245/6 X |
| 3,513,532 | 5/1970 | Lambert | 29/241 X |
| 3,731,365 | 5/1973 | Fryatt | 29/241 |
| 4,187,791 | 2/1980 | Maertel | 29/410 X |

FOREIGN PATENT DOCUMENTS

| | | | |
|---|---|---|---|
| 546320 | 11/1922 | France | 245/6 |

*Primary Examiner*—Charlie T. Moon

*Attorney, Agent, or Firm*—Fleit, Jacobson, Cohn & Price

[57] ABSTRACT

A method and apparatus is proposed for the simultaneous joining together of a multiplicity of individual helical coils in forming a link belt section intended for co-operation with other like sections to produce a link belt of a requisite length, coils of opposite hand being arranged side-by-side in pairs and such pairs being combined together to form the section. Hinge wires are threaded through the interdigitated turns of adjacent coils to maintain the integrity of the total structure.

The apparatus includes a guide means for locating the individual coils one relative to another and a roller nip arrangement through which the coils, in a requisite relative disposition, are caused to pass. Hinge wire insertion means is also provided, whereby individual hinge wires are introduced into the interdigitated turns of adjacent coils.

21 Claims, 4 Drawing Figures

METHOD OF AND APPARATUS FOR ARRANGING HELICAL COILS IN INTERDIGITATED SIDE-BY-SIDE DISPOSITION

The invention concerns a method of arranging flexible helical coils in interdigitated side-by-side disposition and also includes an apparatus for use in practising such method.

In our prior British patent application No. 8015965 we have disclosed a method for the manufacture of a link belt defined by a multiplicity of helical coils wherein adjacent coils are arranged in interdigitated disposition and a respective hinge wire is threaded through the interdigitated turns of each pair of adjacent coils.

The present invention is concerned with a method of and means for effecting the interdigitation of the turns of the respective coils, and particularly, though not exclusively, with the simultaneous interdigitation of a multiplicity of coils.

According to the present invention there is proposed a method for bringing together continuous lengths of flexible, closely-wound helical structures of opposite hand into interdigitated side-by-side relationship comprising the steps of arranging the structures in superimposed laterally overlapping disposition, and causing the structures, when so disposed, to move together into interdigitated relationship.

The invention also includes the method of bringing together coil structures each comprising a pair of coils of opposite hand arranged in interdigitated disposition which comprises the steps of arranging adjacent such structures with a coil of a given hand of one pair in laterally overlapping disposition relative to a coil of opposite hand of the adjacent pair, and causing the respective structures to converge to and through a common throat thereat to move into mutual engagement.

The invention also includes apparatus for progressively bringing closely-wound flexible helical coils or coil structures (hereinafter referred to as coils) into interdigitated side-by-side relationship comprising guide means adapted continuously to receive the coils to be joined and to arrange adjacent such coils in superimposed, laterally overlapping disposition, a non-planar, outwardly facing support surface for contact by at least one of any two adjacent coils, and means adapted to constrain the said at least one coil or the coils for movement along a path defined by the said surface and to cause the overlapping regions of adjacent such coils to move into interdigitated disposition.

The invention will now be described further, by way of example only, with reference to the accompanying diagrammatic drawings, illustrating one embodiment thereof, and in which.

Figure 1:
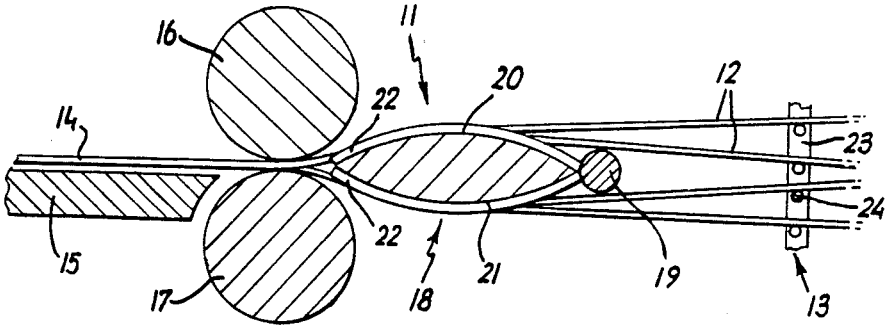
FIG. 1 is a side elevation of apparatus for use in combining side-by-side helical coils.

Referring now to the drawings, and particularly to FIG. 1, apparatus for combining a plurality of flexible, closely-wound helical coils of synthetic monofilament material in interdigitated side-by-side disposition comprises a coil combining apparatus 11 receiving a plurality of coils 12 from a source thereof (not shown) via separator comb 13 and delivering a sheet 14 of interdigitated coils to a support table 15 for movement therealong.

The coil combining apparatus 11 comprises a pair of nip rollers 16, 17 rotatably supported in a frame (not shown), the upper roller 16 being removably mounted in upstanding trunnions and being loaded into contact with the opposing lower roller 17 through a yoke engaged with the trunnions and bearing on a respective roller end. The lower roller may be driven, although, in the arrangement illustrated, such roller is operated manually by way of a handle secured thereto. The apparatus 11 further includes a locator bar 18 immediately adjacent to and in alignment with the roller nip, and between the rollers 16, 17 and the comb 13, and a guide bar 19 adjacent the locator bar 18 and at that side thereof remote from the said rollers 16, 17. The locator bar 18 has arcuate upper and lower surfaces 20, 21 and each such surface has a plurality of equi-spaced transverse ribs 22 upstanding therefrom, the ribs 22 of the respective surfaces 20, 21 being offset by a distance of one half of the common pitch of the ribs. The plane of symmetry of the locator bar 18 passes through the nip between the pressure rollers 16, 17 and contains the diameter of the guide bar 19, such plane further being coincident with that of the top of the support table 15.

The separator comb 13 comprises a plurality of upstanding, equi-spaced rods 23 and horizontally disposed spacer bars 24, the number of rods being determined by the number of coils, the space between adjacent rods 23 generally being intended to receive a total of four coils, and there being, in total, four spacer bars 24.

In practising the method of the invention, a requisite number of coils 12, say sixty four, each in a respective can (not shown), is provided, and the individual coils are threaded through the comb 13, one half of the coils being engaged with the upper part of the comb to pass across the top of the guide bar 19 and locator bar 18 to the roller nip and the other half being engaged with the lower part of the comb to pass below the bars 19, 18. Adjacent ones of the individual coils of the separate sheets thereof as respectively defined by the coils passing above or below the guide bar 19 are successively of opposite hand. Additionally, the individual coils of the two sheets are so arranged that, at the locator bar 18, successive coils 12 of a composite of the upper and lower sheets are likewise of opposite hand.

Adjacent and successive pairs of coils of the upper sheets thereof are engaged with respective successive spaces between adjacent ribs 22 on the upper surface 20 of the locator bar 18, whilst similarly pairs of coils of the lower sheet are located in respective spaces at the underside of the bar, the coils 12 being passed through the roller nip to maintain their relative positions on the locator bar.

On rotation of the lower pressure roller 17 to draw the coils 12 from the cans, a slight tension is applied to the coils such as will cause the successive turns thereof to separate and open slightly on passage across the surface of the locator bar 18, with the effect that individual turns of the coils 12 of opposite hand which exists in a common space between adjacent ribs 22 on the locator bar 18 move into engagement on passage to and through the nip, whilst a similar effect occurs as between the individual coils of the pairs of coils from one surface of the locator bar and the coils of those pairs thereof at the other surface of the bar between which the pairs from the said one surface exist, due to the offset relationship between the ribs 22 at the two surfaces 20, 21.

Figure 2:
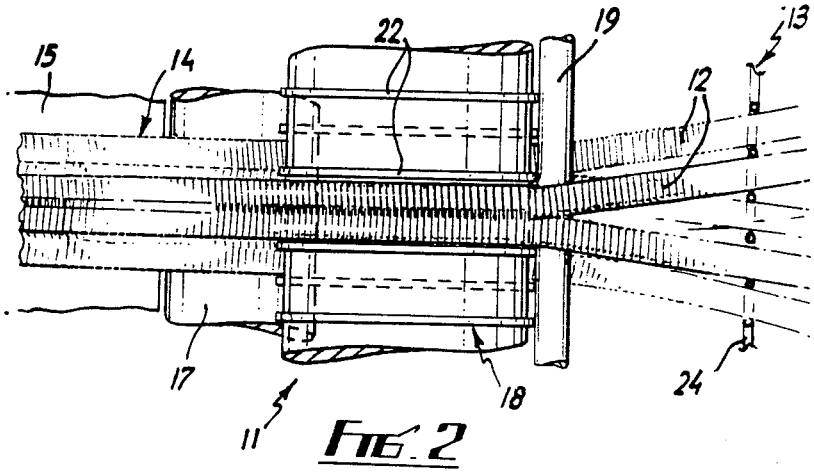
FIG. 2 is a plan view of the arrangement shown in FIG. 1.

As can be seen in FIG. 2, the upper pressure roller 16 having been removed to make more readily apparent the manner in which the coils combine, in moving into the space between adjacent ribs 22 the individual coils engaged with that space lie in overlapping disposition, the space being of a lesser dimension than the corresponding dimension of two side-by-side coils and thereby ensuring, assuming an appropriate selection of the line of feed of the coils, that the requisite overlapping disposition is attained, both as regards the combining of individual coils 12 into pairs and the joining together of pairs from above and below the locator bar 18.

From the roller nip the link belt section 14 passes to the surface of the support table 15.

The link belt section as produced by the combining apparatus of FIGS. 1 and 2, whilst inherently being a coherent structure, requires the insertion of hinge wires if it is to be subjected to significant tensions in the transverse direction of the coils.

Accordingly, the apparatus further includes a hinge wire feed and threading means 25 to which a link belt section as formed on the combining apparatus 11 is presented for the introduction of hinge wires.

Figure 3:
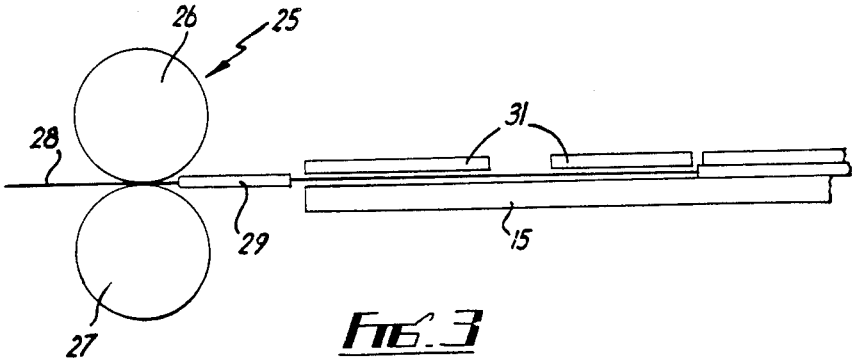
FIG. 3 is a view corresponding to FIG. 1 and shows the means for hinge wire insertion.
Figure 4:
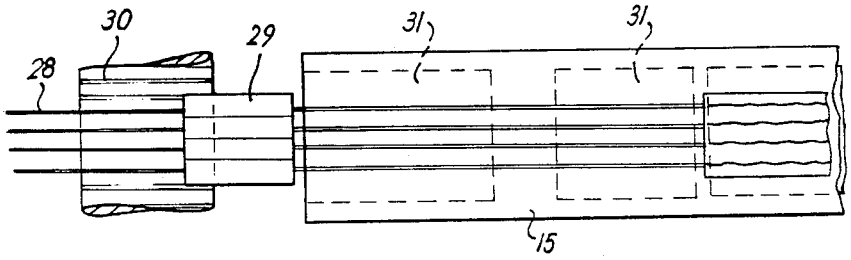
FIG. 4 is a plan view of the arrangement shown in FIG. 3.

The hinge wire feed and threading means 25 is illustrated in FIGS. 3 and 4 and will be seen to comprise a pair of feed rolls 26, 27 through the nip of which is fed a sheet of side-by-side hinge wires 28 in a number according to the number of side-by-side coils 12 to be connected, the upper roller having been omitted from FIG. 4 in the interests of clarity. The lower, driven roller 27 is grooved, whilst the upper, covered roller 26 is loaded into contact therewith through a yoke in similar manner to the upper roller 16 of the combining apparatus 11.

An array of small bore tubes 29 is provided adjacent the roller nip and at the delivery side thereof, the said array of tubes 29 being coplanar with the surface of the support table 15.

Each tube 29 corresponds to and is aligned with a respective groove 30 in the bottom roller 27, and is, furthermore, aligned with a respective groove (not shown) provided in the surface of the support table at that end thereof adjacent to the feed means 25.

On rotation of the rollers 26, 27 the hinge wires 28 are advanced along the table 15 towards the link belt section present thereon and it has been found possible simultaneously to thread such wires 28 through the tunnels formed by the interdigitated turns of the coils 12 throughout the full length of the link belt section.

It may be found desirable to heat the tubes 29 through which the hinge wires pass, thus to straighten the monofilament material and thereby facilitate the threading thereof into the interdigitated turns of the coils.

It may also be found convenient to provide a clear view panel or panels 31 to overlie the interdigitated coils as presented for threading.

In building up a link belt from sections produced in accordance with the foregoing, a requisite number of link belt sections is arranged in side-by-side disposition and adjacent coils of such sections are interdigitated manually, hinge wires then being threaded through the tunnels formed by the interdigitated turns of the said coils to secure the sections together. As will readily be appreciated, the ends of the link belt can be joined together in analogous manner to define an endless belt.

By means of the invention as aforesaid we are able, in a ready and effective manner, simultaneously to handle a large number of individual coils and to form the same into a link belt section for combination with other like sections in producing a link belt of a requisite length. The width of the belt will be determined by the lengths of the individual coils joined together in side-by-side disposition.

I claim:

1. A method of bringing together continuous lengths of flexible, closely-wound helical coils of opposite hand into interdigitated side-by-side relationship to form a coil structure comprising:

providing a guide for continuously receiving the coils to be joined and for arranging such coils in superimposed, and in laterally overlapping disposition;

providing a convex support surface for contact by any two adjacent coils;

drawing the coils continuously along said guide to arrange the coils in superimposed laterally overlapping disposition;

separating the successive turns of at least one of any two adjacent overlapped coils by moving the same over and in contact with a substantial portion of said support surface by said drawing step thus to facilitate subsequent interdigitation of said coils; and causing said superimposed, laterally overlapped coils of which the successive turns of at least one of any two adjacent coils are separated to move into contact with a constraint along a path defined by said support surface, thereby to cause the coils to move together into interdigitated relationship.

2. The method as claimed in claim 1, including the further steps of drawing the underlying one of the superimposed coils to move in contact with a convex support surface and subjecting the overlying one of the said coils to a slight tension, thereby to effect separation of the successive turns of the respective superimposed coils and facilitate interdigitation thereof.

3. The method as claimed in claim 1, wherein both coils are drawn along a non-linear path over a convex supporting surface thereby to bring the outermost coil relative to the convexity into interdigitated relationship with the other coil.

4. The method as claimed in claim 1, further including the step of introducing a respective hinge wire into each tunnel formed by and between adjacent interdigitated coils.

5. The method of bringing together coil structures each comprising a pair of coils of opposite hand arranged in interdigitated disposition comprising the steps of arranging adjacent such structures with a coil of a given hand of one pair in laterally overlapping disposition relative to a coil of opposite hand of the adjacent pair, and drawing the respective overlapped coil structures to converge to and through a common throat thereat to move into mutual engagement, wherein at least one of said overlapped structures is drawn to follow a non-linear path defined by a convex surface in moving into the throat, thereby slightly to separate the successive turns of the coil of the pair intended for interdigitation with the coil of opposite hand of the adjacent pair to facilitate such interdigitation.

6. The method as claimed in claim 5, wherein both structures follow non-linear paths defined by respective inwardly facing convex surfaces.

7. The method as claimed in claim 6, wherein the convex surfaces are moving surfaces.

8. The method as claimed in claim 5, wherein the throat is provided by and between two coaxially arranged rollers defining a nip through which the structures pass.

9. Apparatus for progressively bringing closely-wound flexible helical coils into interdigitated side-by-side relationship comprising:

guide means adapted continuously to receive the coils to be joined and to arrange adjacent such coils in superimposed, and in laterally overlapping disposition;

a convex support surface for contact by at least one of any two adjacent overlapped coils; and means for drawing said adjacent overlapped coils along said guide means along a path defined by a substantial portion of said support surface to cause separation of successive turns thereof upon passage over said support surface and for causing the overlapping regions of adjacent such coils to move into interdigitated disposition.

10. Apparatus as claimed in claim 9, wherein the support surface comprises the surface of a support bar extending transversely of the coils and the guide means includes spaced ribs on such bar and directed transversely thereof.

11. Apparatus as claimed in claim 10, wherein the support bar includes opposed, outwardly directed support surfaces each having respective spaced ribs thereon.

12. Apparatus as claimed in claim 9, wherein the means adapted to constrain said at least one coil for movement along a path defined by the support surface includes means arranged in closely spaced disposition in relation to the surface in the direction of movement of the coils and positioned to hold the relevant ones of the coils in contact with the surface.

13. Apparatus as claimed in claim 12, wherein the means defines a throat in closely spaced disposition relative to the support surface and through which the coils pass.

14. Apparatus as claimed in claim 13, wherein the throat includes a roller nip whereat respective coils alternately from upper and lower surfaces of the support surface are combined in adjacent side-by-side disposition.

15. Apparatus as claimed in claim 9, further including insertion means adapted for the introduction of respective hinge wires into the interdigitated turns of adjacent coils.

16. Apparatus as claimed in claim 15, wherein the insertion means comprises hinge wire feed means, threading means and a support table having a support surface.

17. Apparatus as claimed in claim 16, wherein the hinge wire feed means comprises a grooved roller relative to which the support surface is tangential.

18. Apparatus as claimed in claim 16, wherein the hinge wire feed means comprises a pair of rollers defining a roller nip therebetween, one of said rollers being grooved to receive individual wires in spaced side-by-side disposition thereon, the support surface being tangential to the roller nip.

19. Apparatus as claimed in claim 17, wherein the threading means includes a coplanar array of small bore tubes, each tube being arranged in alignment with a respective groove in the roller at the delivery side thereof, the said array being coplanar with the said support surface.

20. Apparatus as claimed in claim 19, wherein the tubes are provided at a pitch such that each tube is positioned symmetrically in relation to and is aligned with a respective tunnel formed by the interdigitated turns of two adjacent coils.

21. Apparatus as claimed in claim 15, further including a panel overlying the support surface and in closely spaced disposition relative thereto, the panel extending outwardly beyond the ends of the tubes.

* * * * *